US005467100A

United States Patent [19]

Chen

[11] Patent Number: 5,467,100

[45] Date of Patent: Nov. 14, 1995

[54] SLOT-COUPLED FED DUAL CIRCULAR POLARIZATION TEM MODE SLOT ARRAY ANTENNA

[75] Inventor: Chien-An Chen, Palos Verdes Estates, Calif.

[73] Assignee: TRW Inc., Redondo Beach, Calif.

[21] Appl. No.: 104,460

[22] Filed: Aug. 9, 1993

[51] Int. Cl.[6] ..... H01Q 13/10

[52] U.S. Cl. ..... 343/770; 343/771; 343/756

[58] Field of Search ..... 343/770, 771, 343/756, 909, 767, 768, 700; H01Q 13/10

[56] References Cited

U.S. PATENT DOCUMENTS

| | | | |
|---|---|---|---|
| 3,990,078 | 11/1976 | Bellee et al. | 343/770 |
| 4,197,541 | 4/1980 | Nemit et al. | 343/771 |
| 4,263,598 | 4/1981 | Bellee et al. | 343/700 |
| 4,387,377 | 6/1983 | Kandler | 343/786 |
| 4,698,638 | 10/1987 | Branigan et al. | 343/770 |
| 4,716,415 | 12/1987 | Kelly | 343/770 |
| 4,786,914 | 11/1988 | Wu et al. | 343/909 |
| 4,821,044 | 4/1989 | Kurtz | 343/771 |
| 4,916,458 | 4/1990 | Goto | 343/771 |
| 4,929,959 | 5/1990 | Sorbello et al. | 343/700 |
| 4,958,165 | 9/1990 | Axford et al. | 343/770 |
| 5,086,301 | 2/1992 | English et al. | 343/756 |
| 5,173,714 | 12/1992 | Arimura et al. | 343/770 |
| 5,175,561 | 12/1992 | Goto | 343/769 |
| 5,177,496 | 1/1993 | Arimura et al. | 343/771 |
| 5,194,876 | 3/1993 | Schnetzer et al. | 343/769 |
| 5,255,004 | 10/1993 | Berkowitz et al. | 343/853 |
| 5,258,768 | 11/1993 | Smith | 343/786 |
| 5,262,791 | 11/1993 | Tsuda et al. | 343/700 |
| 5,270,721 | 12/1993 | Tsukamoto et al. | 343/700 |

FOREIGN PATENT DOCUMENTS

| | | |
|---|---|---|
| 0546601 | 11/1992 | European Pat. Off. . |
| 4213560 | 4/1992 | Germany . |

OTHER PUBLICATIONS

K. Ito, "Planar Antennas For Satellite Reception", Dec. 1988, IEEE Transactions on Broadcasting, vol. 34, No. 4.

*Primary Examiner*—Donald Hajec
*Assistant Examiner*—Hoanganh Le

[57] ABSTRACT

A slot antenna is provided which includes first and second oppositely disposed metallic plates with a dielectric layer disposed therebetween. An array of horizontal and vertical radiating elements are formed on the first metallic plate. An array of horizontal coupling slots and an array of vertical coupling slots are formed in the second metallic plate. The antenna further includes first and second beam formers for providing a necessary field of view beam coverage. The array of horizontal coupling slots are operatively coupled to the first beam former and the array of vertical coupling slots are operatively coupled to the second beam former. Accordingly, the slot antenna may operate to transmit and receive linearly polarized energy. The antenna may further include a polarizer disposed above the upper metallic plate for converting between linear and circular polarization so as to allow for antenna operation with single or dual circular polarization energy.

18 Claims, 3 Drawing Sheets

SLOT-COUPLED FED DUAL CIRCULAR POLARIZATION TEM MODE SLOT ARRAY ANTENNA

BACKGROUND OF THE INVENTION

1. Technical Field

This invention relates generally to a slot antenna and, more particularly, to a dual circular polarization double-layer slot array antenna which is capable of providing a dual circular polarized beam with optimum efficiency and bandwidth.

2. Discussion

Direct communication systems commonly employ antennas for transmitting and receiving energy between remote locations. Modernly, antennas are widely employed for an increasing number of applications, many of which require a low profile, wide bandwidth antenna that can operate with polarized radiating energy. For example, advanced Direct Broadcast Systems (DBS) are currently being developed for future generation cable television transmission. Currently, North America Direct Broadcast Systems are being developed which transmit circular polarized (CP) energy. These systems require low cost dual circular polarization eighteen inch aperture antennas at remote television locations for receiving the circular polarized signals via satellite transponders.

In the past, conventional reflector antennas were used which typically consisted of a reflector operatively coupled to a feed horn (polarizer) via a strout and an associated mounting structure. Such antennas include a Cassegrain antenna in which the feedhorn is displaced from the reflector at a focal point on the front side thereof. However, such conventional reflector antennas generally occupy a relatively large volume and are easily susceptible to damage from the environment.

More low profile antenna concepts have been developed which include planar slot antennas. One type of slot antenna includes a double-layer structure which forms two propagation layers. Double-layer slot antennas historically have included the excitation of a transverse-electromagnetic (TEM) mode travelling wave between a pair of parallel metallic plates. This type of slot antenna further involves radio frequency (RF) energy leakage through radiating slots formed on the upper metallic plate so as to form a boresight pencil beam. Such slot antennas have generally exhibited a relatively simple mechanical structure with potentially low fabrication costs. However, there are recognized limitations associated with the conventional slot antenna approaches. These limitations include the fact that either single feed designs or overly complicated multiple feed designs are generally employed to excite a pure TEM mode travelling wave between the parallel plates. While a number of feed design approaches have been proposed, the prior concepts are generally limited to a single polarization (CP or linear) or involve high complexity and exhibit low efficiency with a relatively narrow bandwidth.

Another type of slot antenna includes a radial line slot array antenna which has either a single or double layer structure with a plurality of coupling slots formed along spiral pattern. An example of one such radial line slot antenna is described in U.S. Pat. No. 5,175,561 issued to Goto. Such single-layer slot antennas have been employed for Direct Broadcast Systems in Japan and are generally capable of operating with single polarization energy only. That is, the radial line slot array may handle only either right hand or left hand circular polarization. An additional feed on another layer could be added to the single layer radial line slot array to provide dual circular polarization beams. However, the two beams would be dependent upon each other and optimization of one would degrade the other. That means if one circular polarized beam is optimized, then the other circular polarized beam will likely exhibit rather poor performance. As a consequence, the radial line slot array generally is not capable of effectively handling the combination of both right hand and left hand circular polarization, while achieving reasonably acceptable bandwidth and performance criteria.

It is therefore desirable to provide for a low profile planar dual circular polarization slot array antenna which overcomes limitations associated with the abovementioned prior art approaches. It is further desirable to provide for a double-layered slot antenna which is capable of operating with both right hand and left hand circular polarization and involves relatively low fabrication costs and less complexity, while maintaining high efficiency and wide bandwidth capabilities. In addition, it is further desirable to provide for such a slot antenna which exhibits two circular polarized beams which are optimized independent of one another.

SUMMARY OF THE INVENTION

In accordance with the teachings of the present invention, a slot antenna is provided which includes first and second oppositely disposed metallic plates with a dielectric layer disposed therebetween. An array of horizontal and vertical radiating elements are formed on the first metallic plate. An array of horizontal and vertical coupling slots are formed on the second metallic plate. The antenna further includes a pair of beam formers each coupled to a radio-wave connector. The array of horizontal coupling slots are operatively coupled to a beam former and the array of vertical coupling slots are operatively coupled to another beam former so that RF energy may pass therebetween. According to this arrangement, the slot antenna may operate to transmit and receive linearly polarized energy. The antenna may further include a polarizer disposed above the tipper metallic plate for converting between linear and circular polarization so as to allow for antenna operation with single or dual circular polarization energy.

BRIEF DESCRIPTION OF THE DRAWINGS

Other objects and advantages of the present invention will become apparent to those skilled in the art upon reading the following detailed description and upon reference to the drawings in which.

DETAILED DESCRIPTION OF THE PREFERRED EMBODIMENTS

Figure 1:
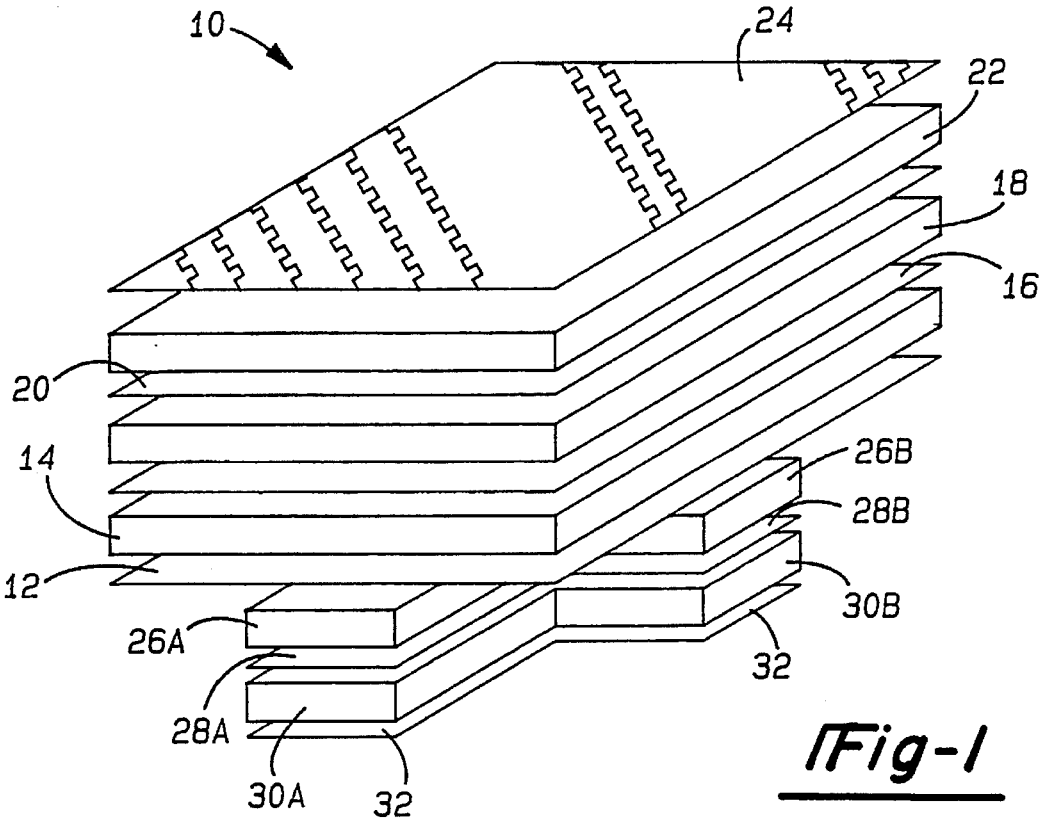
FIG. 1 is an exploded view of a circular polarization slot array antenna in accordance with one embodiment of the present invention.

Turning now to FIG. 1, a slot array antenna 10 is shown therein in accordance with the present invention for handling dual circular polarization energy. The slot antenna 10 described hereinafter preferably operates with transverse-electromagnetic (TEM) energy propagating within a pair of metallic plates and is capable of transmitting and/or receiving both right hand and left hand circular polarized energy. Alternately, the present antenna 10 may be adapted to operate with linear (i.e., horizontal and vertical) polarization energy according to a second embodiment provided herein.

According to one embodiment, the slot array antenna 10 generally includes a pair oppositely disposed metallic plates 12 and 16 which are separated from one another via a layer of dielectric material 14. Dielectric layer 14 has a preferred dielectric constant approximately 4.0, yet a dielectric constant of 2.2 may be suitable for most applications. The upper metallic plate 16 generally includes a plurality of vertical and horizontal radiating elements (slots) arranged in a two-dimensional array, while the lower metallic plate 12 has a plurality of horizontal and vertical coupling slots formed therein. According to this double-layer antenna structure, the metallic plates allow a transverse-electromagnetic (TEM) mode traveling wave to be excited therebetween. As a consequence, radio frequency (RF) energy which has a linear polarization with horizontal and vertical components is able to penetrate the appropriate radiating elements and coupling slots.

Figure 2:
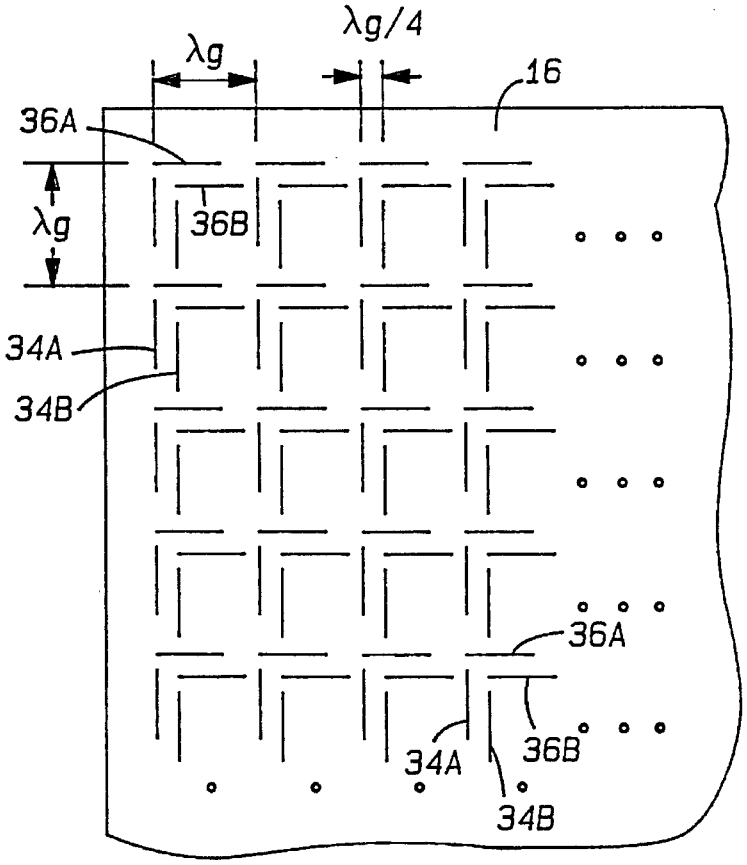
FIG. 2 is a top view of a portion of the upper metallic sheet having radiating elements formed thereon in accordance with the present invention.

With particular reference to FIG. 2, a portion of the upper metallic plate 16 is shown with vertical radiating elements 34A and 34B and horizontal radiating elements 36A and 36B formed therein. The vertical and horizontal radiating elements 34 and 36 are essentially very thin slots which extend through upper metallic plate 16 and are formed in parallel pairs. Each pair of vertical radiating elements 34A and 34B preferably has a vertical offset between the two radiating elements making up each corresponding pair. The offset is equal in distance to approximately one-quarter of a wavelength ($\frac{1}{4}\lambda_g$), where the wavelength $\lambda_g$ is that of the TEM propagating within metallic plates 12 and 16. Likewise, each pair of horizontal radiating elements 36A and 36B preferably has a horizontal offset equal to approximately one-quarter wavelength ($\frac{1}{4}\lambda_g$) of the TEM energy.

Adjacent pairs of vertical radiating elements 34A and 34B are displaced from each other the distance of about one wavelength $\lambda_g$ of the operating TEM energy. Similarly, adjacent pairs of horizontal radiating elements 36A and 36B are also displaced from each other the distance of about one wavelength $\lambda_g$. According to the arrangement of radiating elements shown on FIG. 2, linear polarized energy is able to efficiently pass through the radiating elements 34 and 36. In doing so, the horizontal polarization component thereof passes through metallic plate 16 via the vertical radiating elements 34A and 34B, while the vertical polarization component of the linear polarized energy passes therethrough via the horizontal radiating elements 36A and 36B.

Each pair of radiating elements 34 and 36 are preferably designed to have a length that may vary in length from the other pairs. This is because the length of the radiating elements 34 and 36 are designed such that a uniform amplitude of energy is radiated or received so as to provide for maximum antenna aperture efficiency. Vertical radiating elements 34A and 34B which are in closer proximity to the corresponding vertical coupling slots on lower metallic plate 12 receive more energy and therefore have shorter length, while the more distant radiating elements have a longer length to compensate for the lower of amount of energy associated therewith. Horizontal radiating elements 36A and 36B likewise have the same dimensional variations. Accordingly, the array of vertical radiating elements 34A and 34B can essentially be designed and optimized independent of the horizontal radiating elements 36A and 36B.

Figure 3:
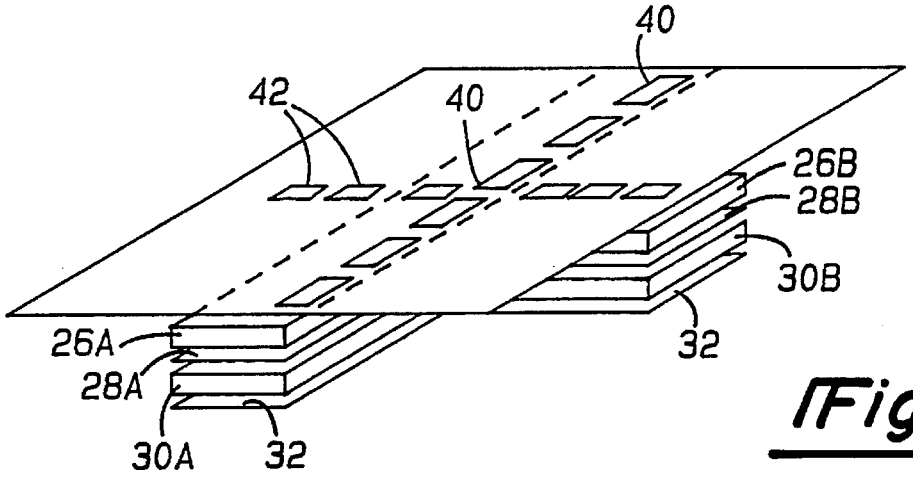
FIG. 3 is a view of the bottom metallic sheet with horizontal and vertical coupling slots formed therein in accordance with the present invention.
Figure 5:
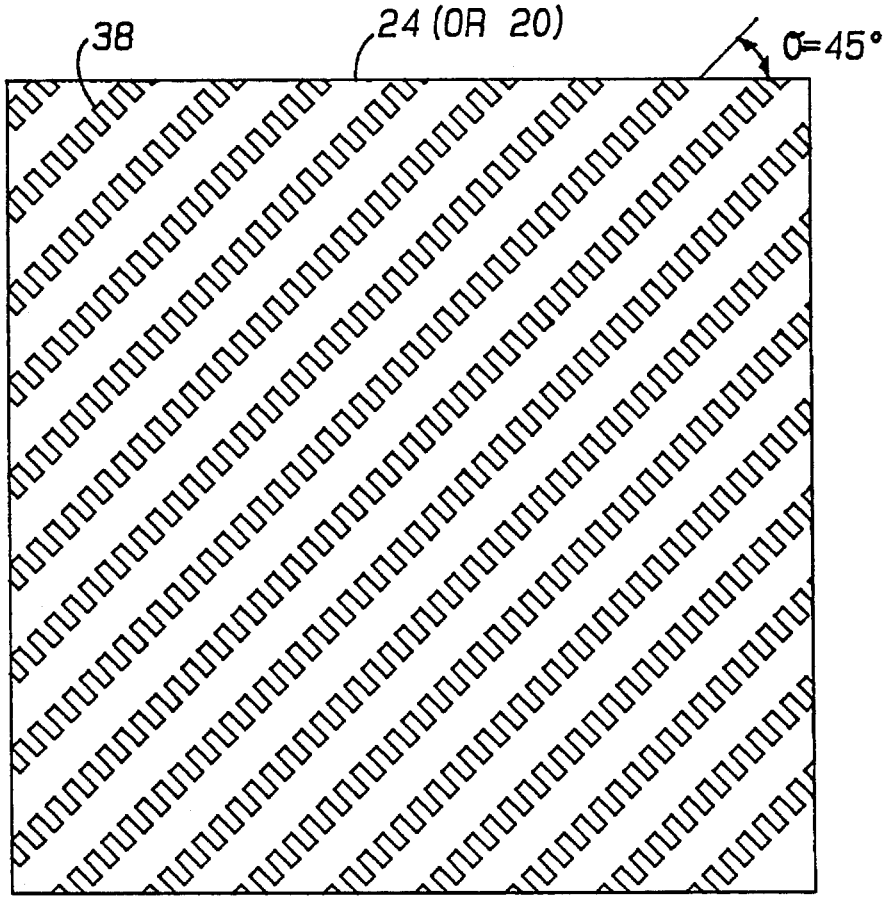
FIG. 5 is a schematic representation of a Meanderline polarizer sheet employed by the present invention.

The bottom metallic plate 12 is shown in FIG. 3 and has a vertical N×1 array of rectangular coupling slots 40 and a horizontal N×1 array of rectangular coupling slots 42 formed therein. The vertical and horizontal arrays of coupling slots 40 and 42 are arranged orthogonal to one another. The vertical and horizontal coupling slots 40 and 42 operate to either excite the respective horizontal and vertical polarization energy onto stripline beam forming networks 28A and 28B, respectively, or receive energy therefrom. The stripline beam forming networks 28A and 28B are disposed below the lower metallic plate 12 and separated therefrom via a dielectric layer 26A or 26B. The beam forming networks 28A and 28B each have a respective foam sheet 30A and 30B disposed on the bottom side thereof. A conductive ground plane is disposed on the bottom side of the foam sheets 30A and 30B to form stripline circuitry making up the beam forming networks 28A and 28B.

Figure 4:
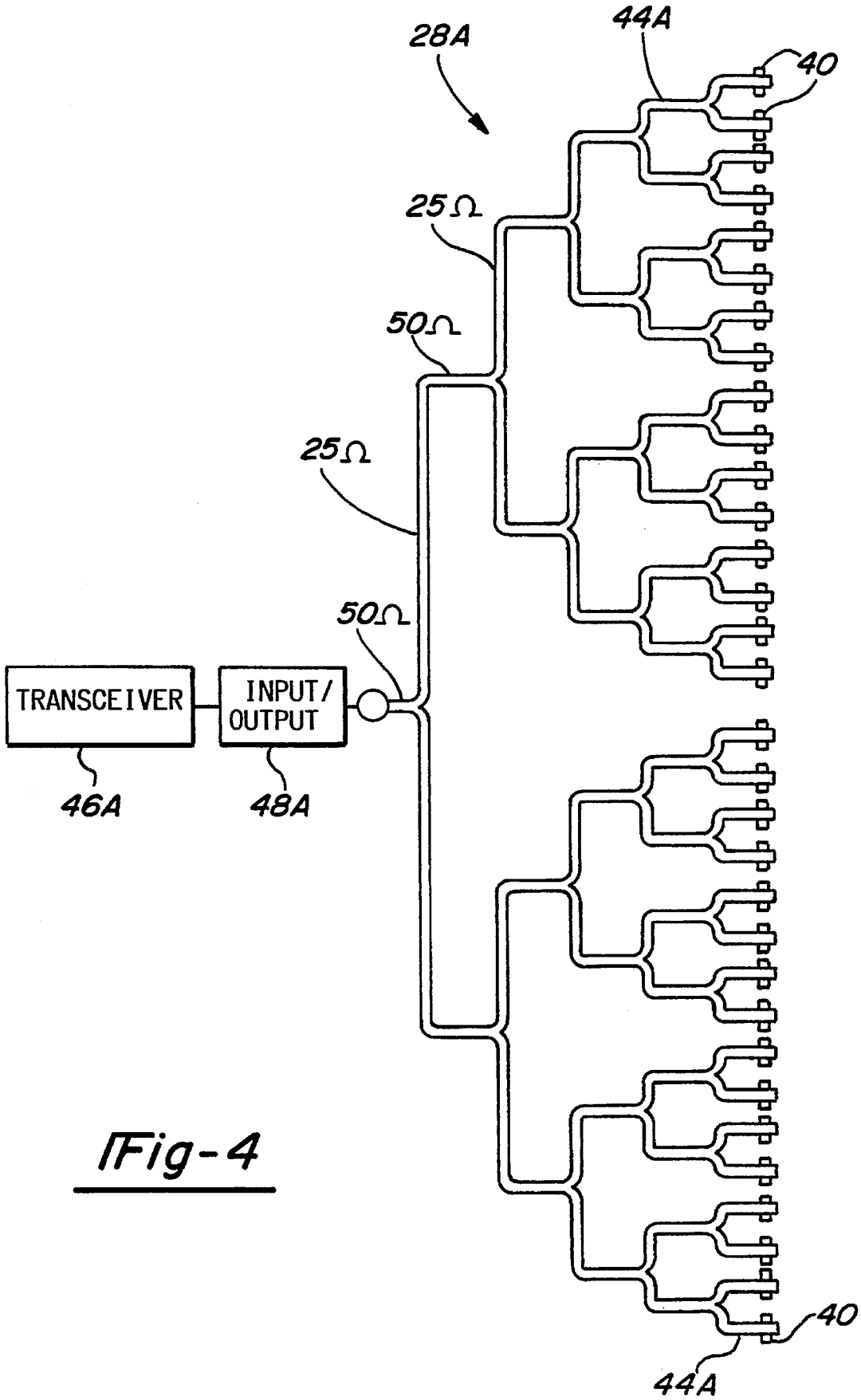
FIG. 4 is a schematic representation of a stripline beam forming network employed in accordance with present invention.

A detailed illustration of one beam forming network 28A is provided in FIG. 4. The beam forming network 28A is formed of stripline circuit trace 44 with finger traces that extend across a portion of the vertical coupling slots 40. During signal reception, energy radiates across vertical coupling slots 40 and excites a current onto the stripline circuit trace 44. The current on circuit trace 44 is fed along beam forming network 28A to an input/output port 48A which in turn may be coupled to a transceiver 46 or other electronic device. During transmission, currents are induced on stripline circuit trace 44 which in turn excite radiating energy on coupling slots 40.

The beam forming network 28A is designed so as to provide the desired beam pattern of the antenna 10. The design criteria may include the proper selection of impedance throughout the stripline circuit trace 44 so as to control the amplitude of the signal excited across the associated coupling slot 40. The other beam forming network 28B is identical to the beam forming network 28A shown in FIG. 4 with the exception that beam forming network 28B is orthogonal to beam forming network 28A and is coupled to the horizontal coupling slots 42. For dual polarization operations, there are two input/output ports which include a first port 48A that is connected to the first beam forming network 28A and a second port (not shown) that is connected to the second beam forming network 28B.

In addition, the slot antenna 10 further includes a pair of meanderline polarizer sheets 20 and 24 disposed above the upper metallic plate 16 and separated therefrom via foam sheet 18. A foam sheet 22 is further disposed between the lower and upper polarizer sheets 20 and 24 for providing a separation distance therebetween. Each of the meanderline polarizer sheets 20 and 24 are conventional polarizers which employ a square-wave printed-circuit pattern oriented at a forty-five degree angle to provide reactive loading to the orthogonal linear component of an electric field. Accordingly, each of the polarizer sheets 20 and 24 causes a differential electrical phase shift between two orthogonal fields. Thus, the two polarizer sheets 20 and 24 combined together provide a ninety degree phase differential of the orthogonal incident waves so as to provide a conversion between linear and circular polarization energy. Therefore, circular polarized energy is converted to a linear polarization as the energy passes through polarizer sheets 20 and 24, while linear polarization energy likewise is converted to circular polarization.

In operation, the slot antenna 10 may be employed to transmit and/or receive dual circular polarized energy according to one embodiment of the present invention. When receiving, radiating energy penetrates the upper and lower meanderline polarizer sheets 24 and 20. Energy which has a circular polarization associated therewith is thereby converted to linear polarized energy which has either horizontal or vertical polarization components. The converted linear polarized energy is directed onto the upper metallic plate 16. The vertical radiating elements 34A and 34B in tipper metallic plate 16 allow the horizontal component of linear polarization to penetrate therethrough in the form of a first set of linear polarized boresight beams. Likewise, the horizontal radiating elements 36A and 36B in metallic plate 16 operate to allow the vertical component of the linear polarization to penetrate therethrough in the form of a second set of linear polarized boresight beams.

The two sets of boresight beams are independent of one another and essentially propagate between the lower metallic plate 12 and the upper metallic plate 16. The RF energy from the boresight beams is then fed to one of the two beam forming networks 28A or 28B via the vertical and horizontal coupling slots 40 and 42. For instance, the RF energy across vertical coupling slot 40 will excite a current onto the stripline beam forming network 28A which is coupled thereto. The received currents are then fed to an input/output port 48A which in turn may be coupled to a transceiver 46A or other electronic radio-wave device.

The slot antenna 10 may likewise operate to transmit radiating energy which has a circular polarization associated therewith. In doing so, a current is supplied to input/output port 48A which in turn is divided into a number of currents on the stripline beam forming network 28A such that currents flow along the stripline circuit trace 44A. The current flow in turn excites a radiating signal on each associated vertical coupling slot 40 that is coupled thereto. The excited energy propagates between the upper and lower metallic plates 16 and 12 and penetrates the vertical radiating elements 34A and 34B. Another current is supplied to the other input/output port (not shown) which likewise is distributed along beam forming network 28B and excites vertical polarization energy on the horizontal coupling slots 42 and which then penetrates horizontal radiating elements 36A and 36B. The vertical and horizontal polarization energy thereafter passes through the pair of meanderline polarizer sheets 20 and 24 so as to convert the linear polarization to a circular polarization. The circular polarization energy thereafter radiates from the slot antenna 10 within the selected field of view.

The slot array antenna 10 is particularly desirable for use with the Direct Broadcast Systems (DBS) which are currently being developed to receive cable television broadcasts. According to this approach, the slot antenna 10 as described herein is a compact low profile device which may have physical dimensions of eighteen inches by eighteen inches with a depth or one and one-half inches. The slot antenna 10 therefore may easily be used by users as a cable television reception device which may easily be installed within the local vicinity of a television.

While the present invention has been described in connection with energy having a circular polarization, and with particular reference to use with Direct Broadcast Systems, the present invention may be employed in connection with a vast variety of other applications including military and space communication antenna systems. This includes operating with linear polarized signals according to a second embodiment of the present invention. In order to do so, the meanderline polarizer sheets 20 and 24 may be removed so as to allow for the direct transmission and reception of linear polarized energy. According to this alternate embodiment, the vertical and horizontal components of the linear polarization energy received from an external source are directly applied to the upper metallic plate 16 during reception, while such linear components are transmitted from antenna 10 during transmission.

In view of the foregoing, it can be appreciated that the present invention enables the user to achieve a slot antenna which provides dual circular polarization capability. Thus, while this invention has been disclosed herein in connection with a particular example thereof, no limitation is intended thereby except as defined in the following claims. This is because a skilled practitioner recognizes that other modifications can be made without departing from the spirit of this invention after studying the specification and drawings.

What is claimed is:

1. A slot antenna comprising:

first and second oppositely disposed metallic plates spaced separate from one another via a dielectric medium, said first and second plates being adapted to allow transverse-electromagnetic energy to propagate therebetween;

beam forming means for providing a predetermined field of view;

radio-wave connecting means coupled to said beam forming means;

an array of horizontal and vertical radiating elements formed in said first metallic plate; and a first array of horizontal coupling slots and a second array of vertical coupling slots formed in said second metallic plate and operatively coupled to said beam forming means, wherein the coupling slots are electrically coupled to the radiating elements via transverse-electromagnetic energy.

2. The antenna as defined in claim 1 further comprising polarization conversion means disposed above said metallic plates for converting energy between a linear polarization and a circular polarization.

3. The antenna as defined in claim 2 wherein said polarization means comprises a pair of oppositely disposed meanderline polarizer sheets disposed above said metallic plates.

4. The antenna as defined in claim 1 wherein said beam forming means comprises:

a first beam forming network operatively coupled to said first array of horizontal coupling slots; and a second beam forming network operatively coupled to said second array of vertical coupling slots.

5. The antenna as defined in claim 4 wherein each of said first and second beam forming networks include stripline circuitry.

6. The antenna as defined in claim 1 wherein said first and second arrays of coupling slots each comprising a one dimensional array of rectangular slots which are separated from said beam forming means via the dielectric medium.

7. The antenna as defined in claim 6 wherein said horizontal radiating elements are arranged to communicate with the first array of coupling slots and said vertical radiating elements are arranged to communicate with the second array of coupling slots.

8. The antenna as defined in claim 7 wherein each of said radiating elements has a length selected as a function of the distance between each of said elements and the array of rectangular slots communicating therewith so that radiating elements located farther from the slots have a larger length than radiating elements located closer to the slot.

9. The antenna as defined in claim 6 wherein each of said first and second array of coupling slots are substantially centered in the second metallic plate.

10. The antenna as defined in claim 1 wherein said radiating elements are further formed in substantially parallel pairs of elements, each of said pairs of elements having one element offset in length relative to the other element.

11. The antenna as defined in claim 10 wherein said pairs of radiating elements are offset in length and separated by a length of about one quarter wavelength of the transverse-electromagnetic energy.

12. A dual circular polarization slot antenna comprising:

first and second oppositely disposed metallic plates spaced separate from one another via a dielectric medium and which allow transverse-electromagnetic energy to propagate therebetween;

an array of horizontal and vertical radiating elements formed in said first metallic plate;

beam forming means for providing a predetermined field of view;

radio-wave connecting means coupled to said beam forming means and having a first port for channeling vertical polarization energy and a second port for channeling horizontal polarization energy;

a first array of horizontal coupling slots formed in said second metallic plate and operatively coupled to said beam forming means and which cooperate with said horizontal radiating elements so that vertical polarized energy may pass through said horizontal radiating elements and coupling slots;

a second array of vertical coupling slots formed in said second metallic plate and operatively coupled to said beam forming means and which cooperate with said vertical radiating elements so that horizontal polarized energy may pass through said vertical radiating elements and coupling slots; and polarization conversion means disposed above said metallic plates for converting radiating energy between a linear and circular polarization.

13. The antenna as defined in claim 12 wherein said polarization means comprises a pair of oppositely disposed meanderline polarizer sheets disposed above said metallic plates.

14. The antenna as defined in claim 12 wherein said beam forming means comprises:

a first beam forming network coupled to said first array of horizontal coupling slots; and a second beam forming network coupled to said second array of vertical coupling slots.

15. The antenna as defined in claim 14 wherein said first and second beam forming networks include stripline circuitry.

16. The antenna as defined in claim 12 wherein said first and second array of coupling slots each comprise a one dimensional array of rectangular slots which feed said beam forming means.

17. The antenna as defined in claim 12 wherein said radiating elements are formed in substantially parallel pairs of elements, each of said pairs of elements having one element offset in length relative to the other element.

18. A method for receiving circular polarized energy comprising:

receiving circular polarized radiating energy;

transmitting said circular polarized radiating energy through a pair of meanderline polarizer sheets so as to convert said circular polarization to a linear polarization;

passing said linear polarization radiating energy through a first metallic plate having vertical and horizontal radiating elements formed therein so as to allow the horizontal and vertical components of linear polarization to pass therethrough;

radiating transverse-electromagnetic energy of said vertical and horizontal components of linear polarization between said first metallic plate and a second metallic plate which has vertical and horizontal coupling slots formed thereon;

exciting currents on a first beam forming network from said horizontal coupling slots;

exciting currents onto a second beam forming network from said vertical coupling slots; and summing each of the associated currents on each of the beam forming networks to provide a horizontal polarization reception signal and a vertical polarization reception signal.

* * * * *